US006382375B1

(12) United States Patent
Chang

(10) Patent No.: US 6,382,375 B1
(45) Date of Patent: May 7, 2002

(54) SUITCASE CARRIER

(76) Inventor: Wen-Chen Chang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/849,470

(22) Filed: May 3, 2001

(51) Int. Cl.[7] ..... A45C 3/00; A45C 13/00
(52) U.S. Cl. ..... 190/18 R; 280/47.33
(58) Field of Search ..... 190/18 R, 18 A; 280/37, 47.33

(56) References Cited

U.S. PATENT DOCUMENTS 4,538,709 A * 9/1985 Williams et al. ..... 190/18 A
4,618,035 A * 10/1986 Mao ..... 190/18 A
5,323,886 A * 6/1994 Chen ..... 190/18 A
5,469,944 A * 11/1995 Wang ..... 190/18 R
5,524,920 A * 6/1996 Tsai ..... 280/37 X

* cited by examiner

*Primary Examiner*—Lee Young
*Assistant Examiner*—Tri M. Mai

(57) ABSTRACT

A suitcase carrier has a positioning seat, an extension seat, a pair of extension arm plates, and two cover plates. The positioning seat has a chamber to receive the extension seat, a pair of channels, and a pair of inner threaded posts. Each extension arm plate has a first hollow column inserted in the corresponding channel and a second hollow column inserted in the extension seat. Each cover plate is disposed on the corresponding first hollow column.

2 Claims, 8 Drawing Sheets

SUITCASE CARRIER

BACKGROUND OF THE INVENTION

The present invention relates to a suitcase carrier. More particularly, the present invention relates to a suitcase carrier which has an extension seat to be operated smoothly.

Referring to FIGS. 1 to 3, a conventional suitcase carrier has a base frame 10, a U-shaped handle frame 2, two caster support mounts 12 connected to the base frame 10 to receive two casters 3, each of the caster support mounts 12 having a recess hole 11 to receive the U-shaped handle frame 2, four bars 13 connected to the base frame 10, two pedestals 15 connected to two of the bars 13 and disposed on a bottom of the base frame 10, and a generally U-shaped frame 20 having a center portion 21 and two arms 22. Each of the bars 13 has a round hole 14. The base frame 10 has two channels 16 and two grooves 17 communicating with the channels 16. The arms 22 are inserted in the channels 16 of the base frame 10. Each arm 22 has a protruded block 23. Two protrusions 18 are disposed in the channels 16 to engage with the protruded block 23. Two cover plates 19 cover the grooves 17 of the base frame 10. A suitcase 1 is disposed on the base frame 10. When a user pushes the generally U-shaped frame 20 in a deflected direction, the generally U-shaped frame 20 will not move smoothly.

SUMMARY OF THE INVENTION

An object of the present invention is to provide a suitcase carrier which has an extension seat to be operated smoothly.

Accordingly, a suitcase carrier comprises a positioning seat, an extension seat, a pair of extension arm plates, and two cover plates. The positioning seat has a chamber to receive the extension seat, a bottom notch, a pair of channels, a plurality of positioning holes communicating with the channels, and a pair of inner threaded posts. The extension seat has two pairs of pivot apertures, and two lateral walls. Each of the extension arm plates has a first hollow column inserted in the corresponding channel of the positioning seat and a second hollow column inserted in the extension seat. The first hollow column receives a spring and two studs. The second hollow column receives a spring and two pivot shafts. Each of the pivot shafts has an arbor. Each of the cover plates is disposed on the corresponding first hollow column. Each of the cover plates has two blind holes and two hollow lugs. The hollow lugs match the inner threaded posts. Each arbor is inserted in the corresponding pivot aperture of the extension seat. One stud is inserted in one of the positioning holes of the positioning seat, and the other stud is inserted in one of the blind holes of the cover plate. A screw fastens the corresponding hollow lug and the corresponding inner threaded post together.

DETAILED DESCRIPTION OF THE INVENTION

Figure 1:
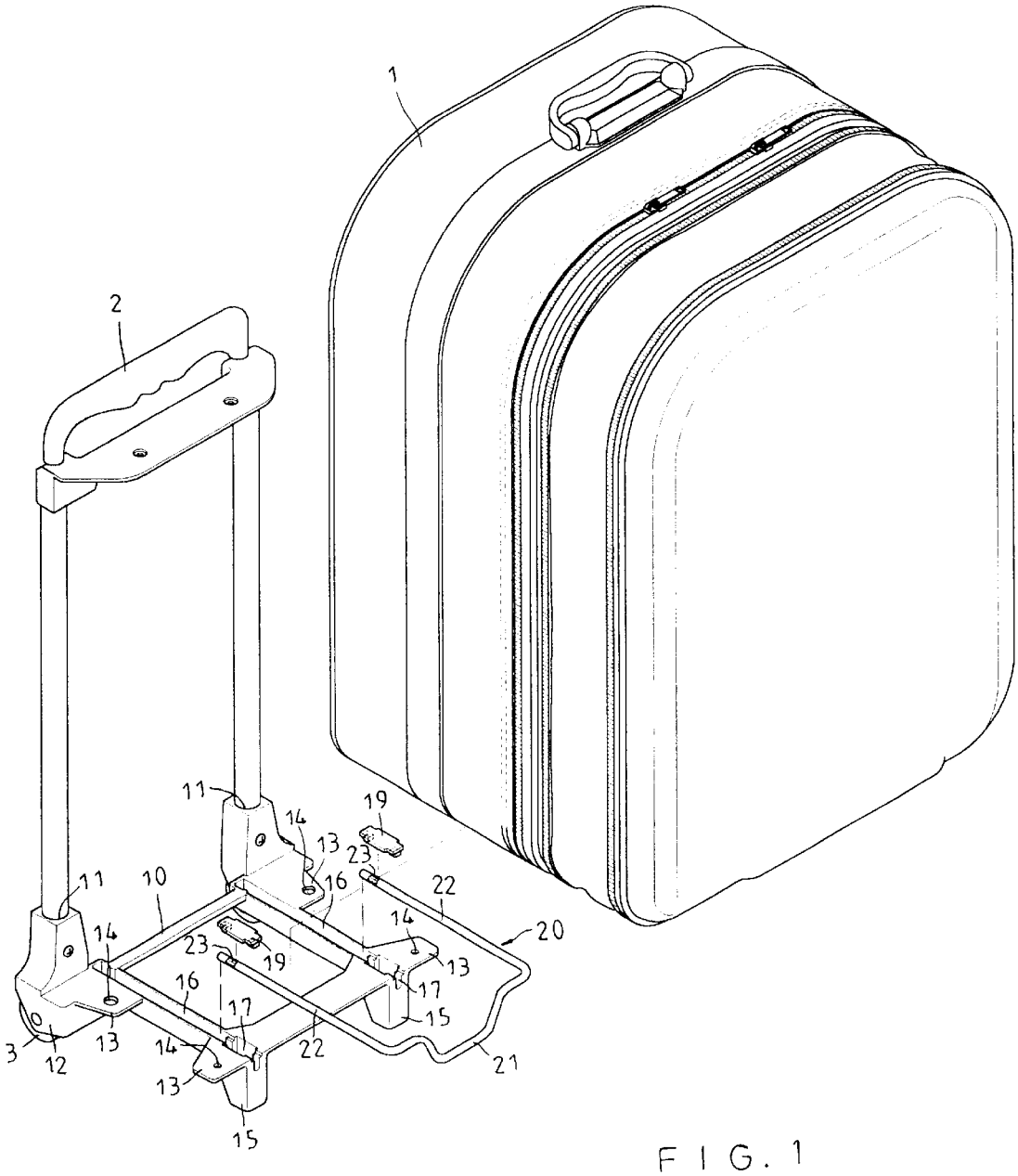
FIG. 1 PRIOR ART
FIG. 1 is a perspective view of a suitcase and a suitcase carrier of the prior art.
Figure 2:
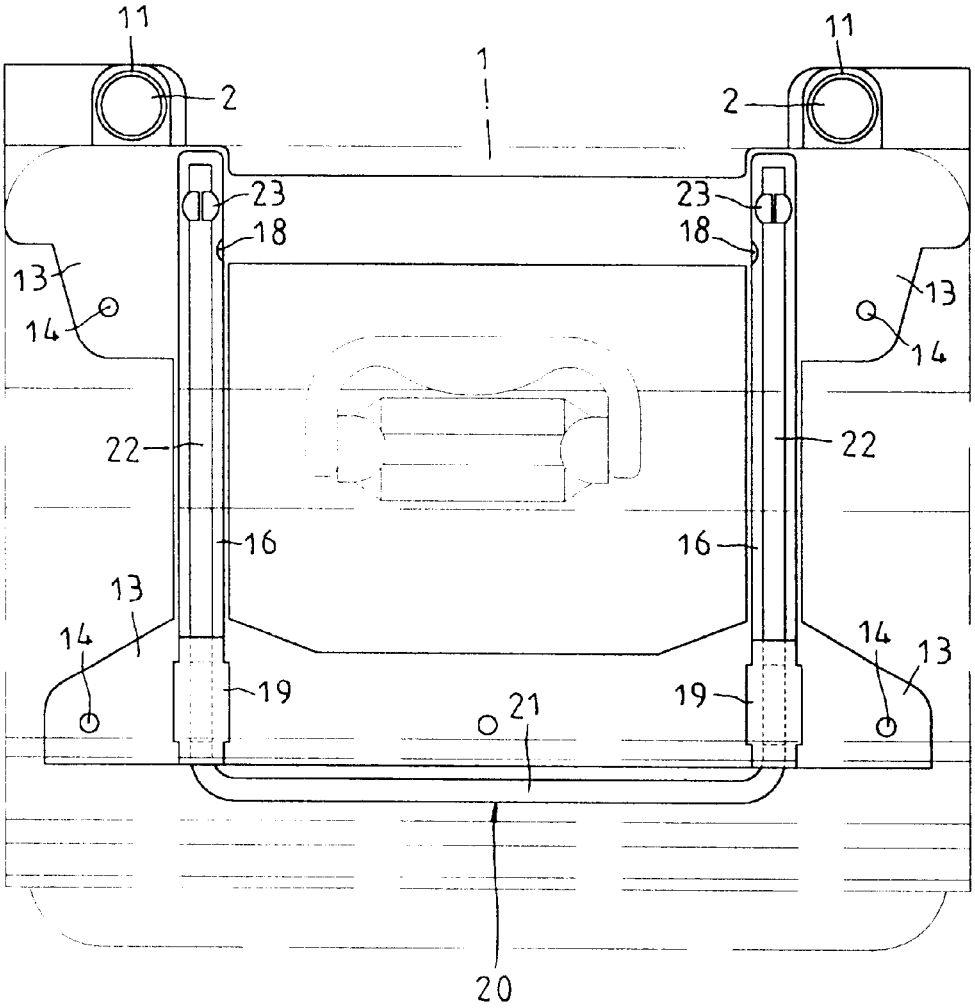
F I G. 2 PRIOR ART
FIG. 2 is an elevation assembly view of a suitcase and a suitcase carrier of the prior art.
Figure 3:
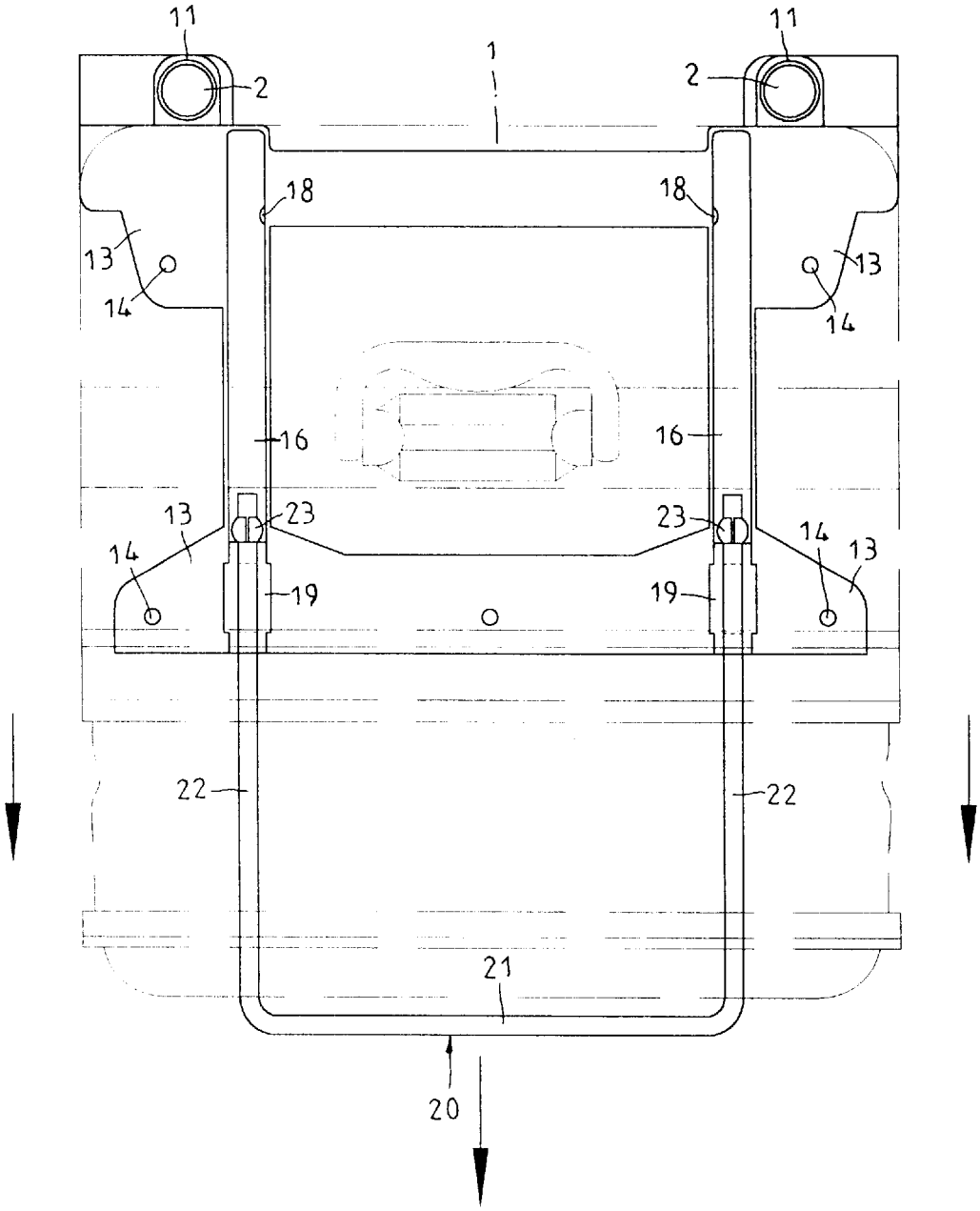
F I G . 3 PRIOR ART
FIG. 3 is a schematic view illustrating an operation of a suitcase carrier of the prior art.
Figure 4:
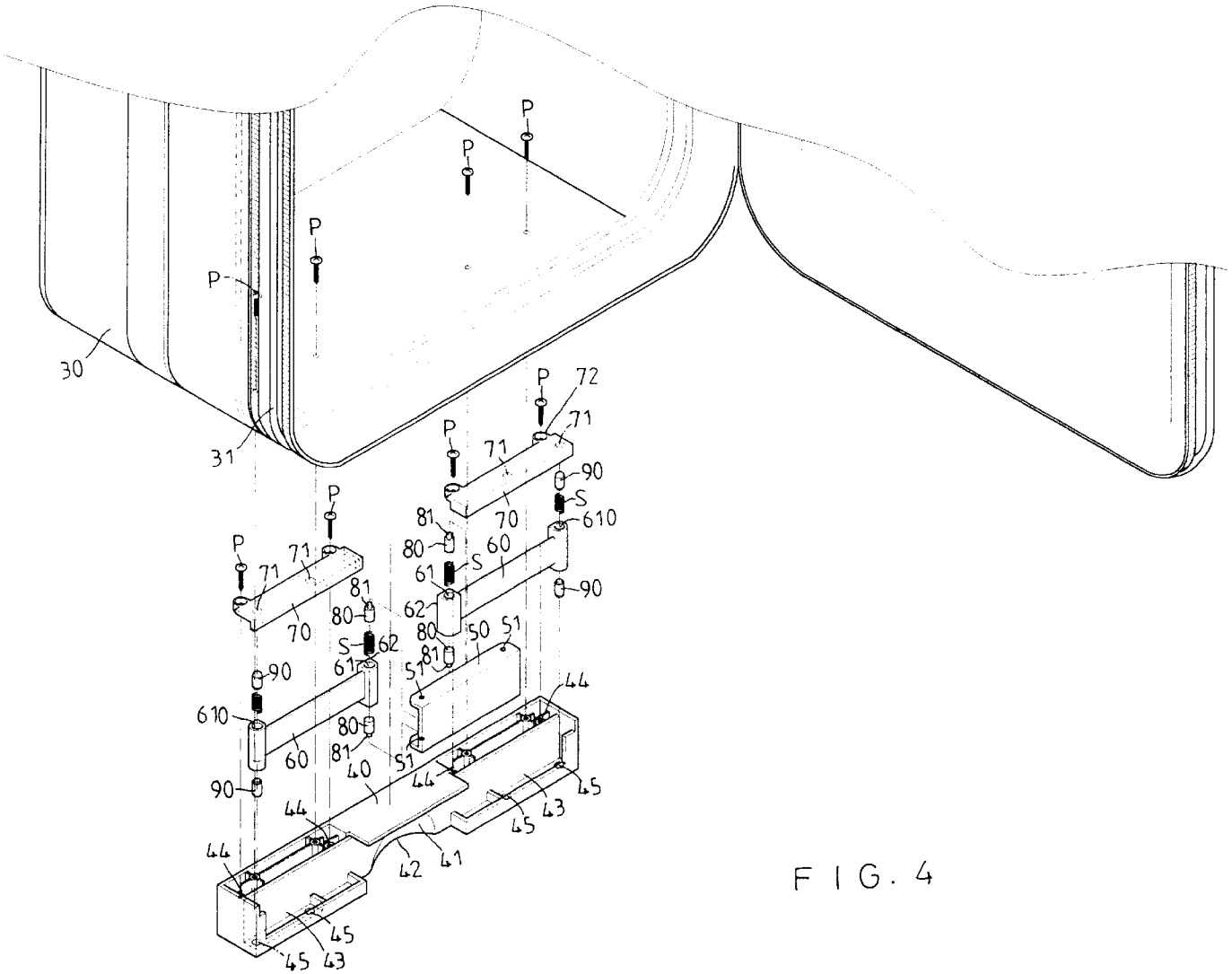
FIG. 4 is a perspective exploded view of a suitcase carrier of, a preferred embodiment in accordance with the present invention.
Figure 5:
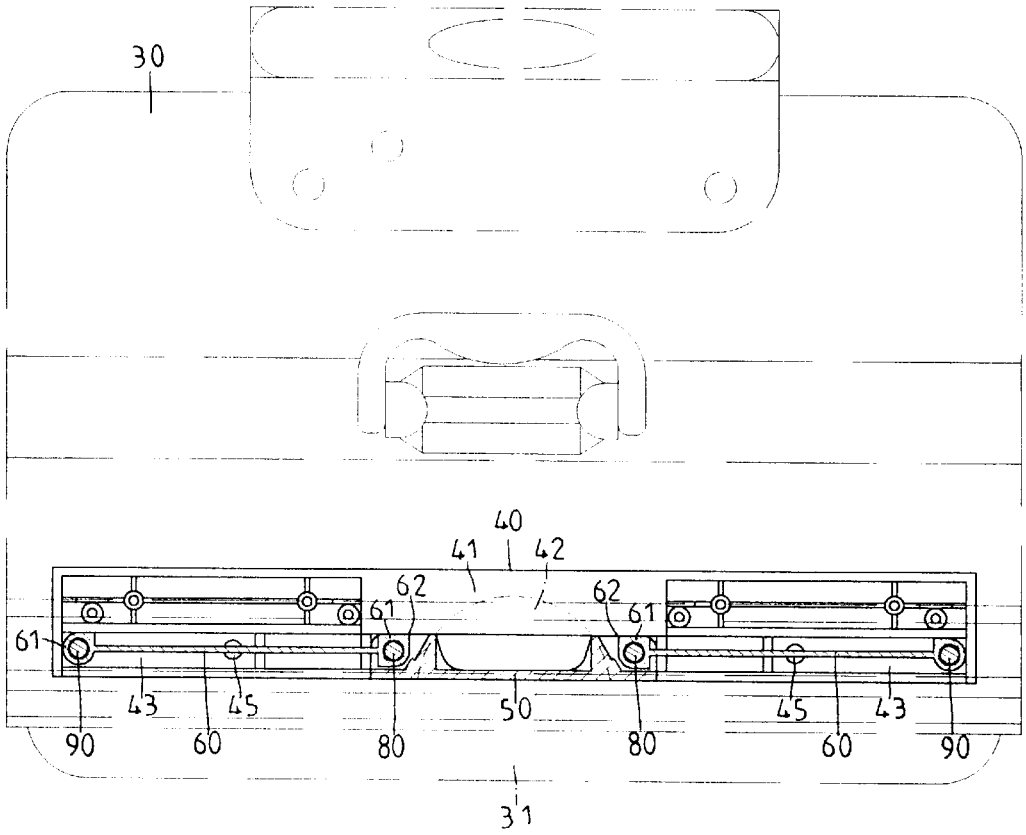
FIG. 5 is a sectional assembly view of a suitcase carrier of a preferred embodiment in accordance with the present invention.
Figure 6:
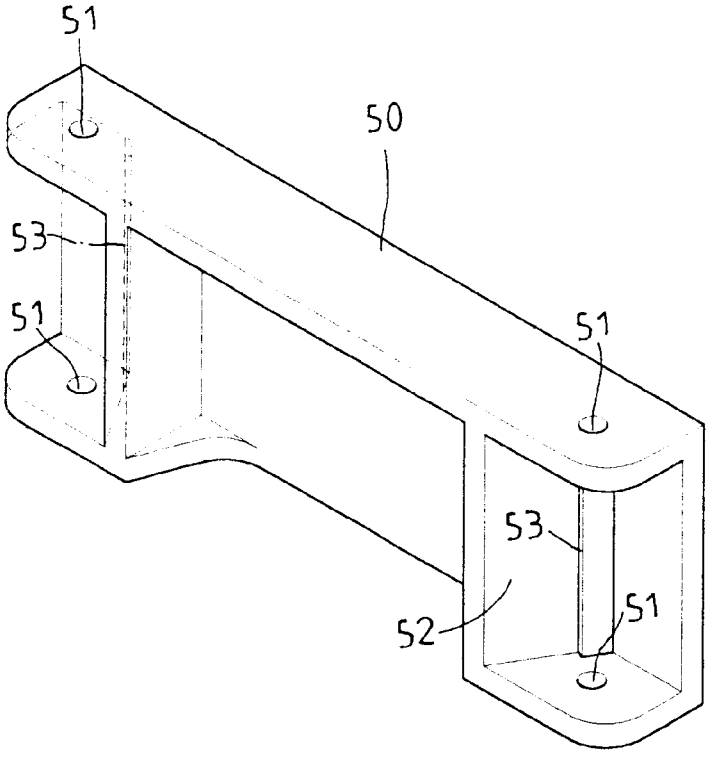
FIG. 6 is a perspective exploded view of an extension seat of a preferred embodiment in accordance with the present invention.
Figure 7:
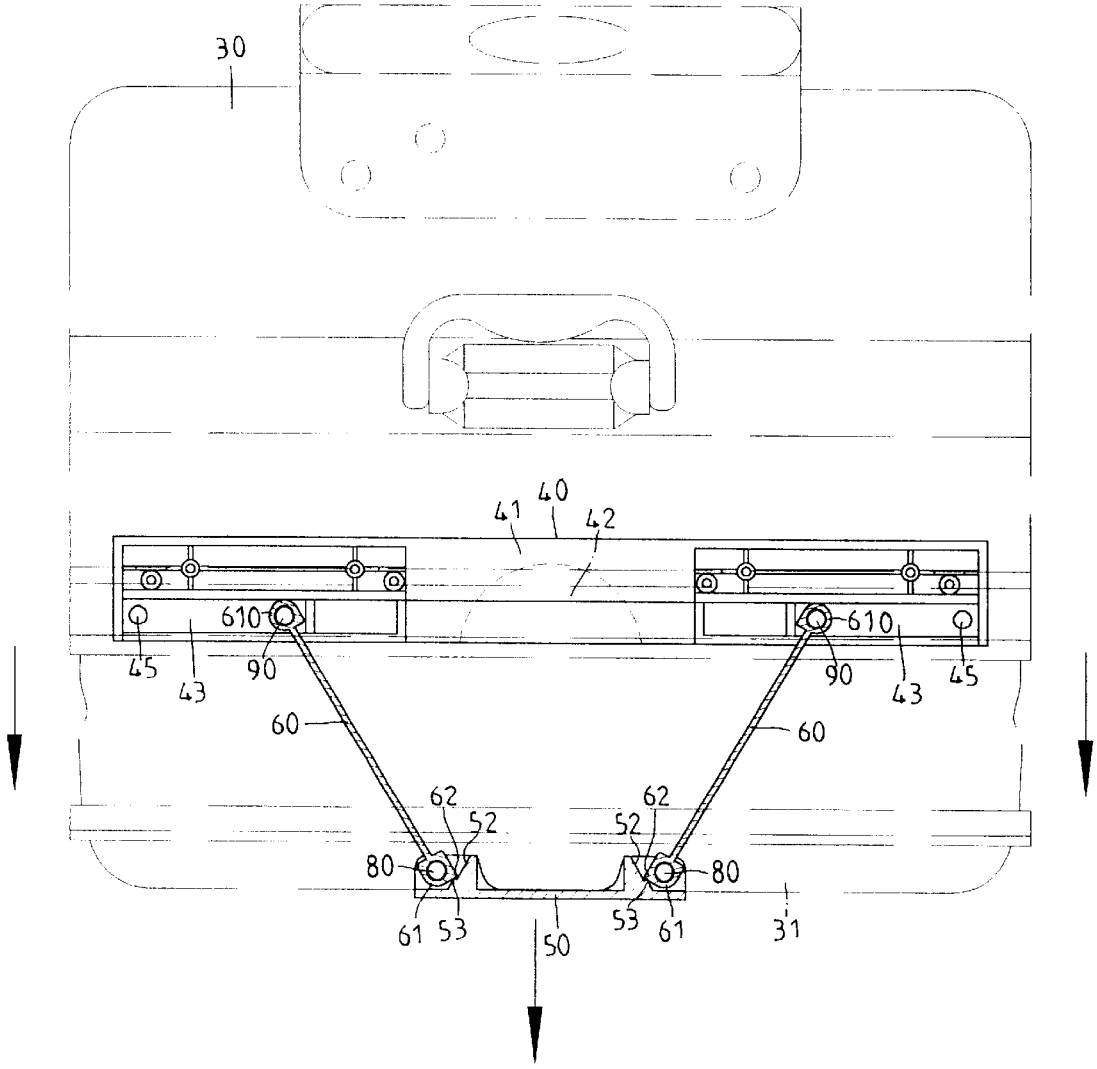
FIG. 7 is a schematic view illustrating an operation of a suitcase carrier of a preferred embodiment in accordance with the present invention.
Figure 8:
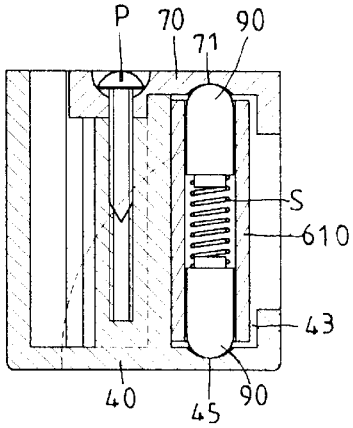
FIG. 8 is a sectional schematic view illustrating a retraction of a suitcase carrier of a preferred embodiment in accordance with the present invention.
Figure 9:
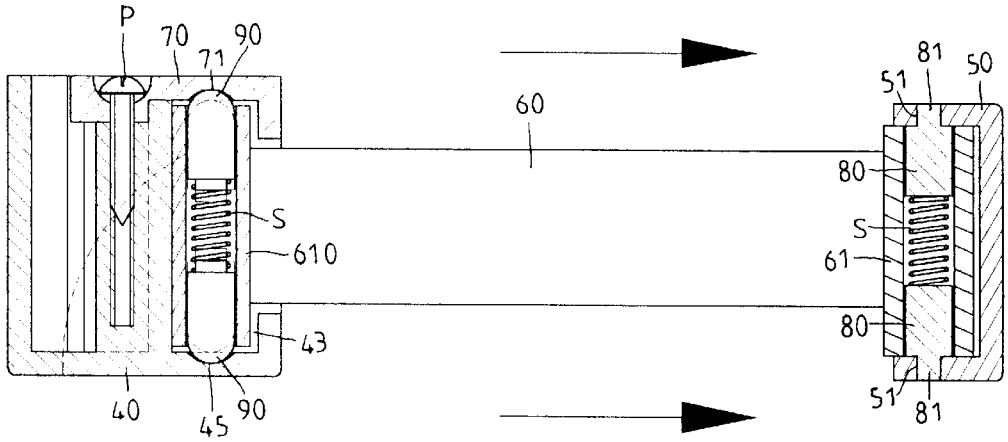
FIG. 9 is a sectional schematic view illustrating an extension of a suitcase carrier of a preferred embodiment in accordance with the present invention.

Referring to FIGS. 4 to 9, a suitcase carrier is disposed on a bottom of a suitcase 30.

The suitcase carrier comprises a positioning seat 40, an extension seat 50, a pair of extension arm plates 60, and two cover plates 70.

The positioning seat 40 has a chamber 41 to receive the extension seat 50, a bottom notch 42, a pair of channels 43, a plurality of positioning holes 45 communicating with the channels 43, and a pair of inner threaded posts 44.

The extension seat 50 has two pairs of pivot apertures 51, two lateral walls 52, and two confining rods 53 disposed on the lateral walls 52.

Each of the extension arm plates 60 has a first hollow column 610 inserted in the corresponding channel 43 of the positioning seat 40 and a second hollow column 61 inserted in the extension seat 50.

The first hollow column 610 receives a spring S and two studs 90.

The second hollow column 61 receives a spring S and two pivot shafts 80.

Each of the pivot shafts 80 has an arbor 81.

Each of the cover plates 70 is disposed on the corresponding first hollow column 610.

Each of the cover plates 70 has two blind holes 71 and two hollow lugs 72.

The hollow lugs 72 match the inner threaded posts 44. Each arbor 81 is inserted in the corresponding pivot aperture 51 of the extension seat 50.

One stud 90 is inserted in one of the positioning holes 45 of the positioning seat 40, and the other stud 90 is inserted in one of the blind holes 71 of the cover plate 70.

A screw P fastens the corresponding hollow lug 72 and the corresponding inner threaded post 44 together.

The positioning seat 40 is fastened on the bottom of the suitcase 30.

The second hollow column 61 has a confining angle 62 engaging with the corresponding confining rod 53.

The invention is not limited to the above embodiment but various modification thereof may be made. Further, various changes in form and detail may be made without departing from the scope of the invention.

I claim:

1. A suitcase carrier comprises:

a positioning seat, an extension seat, a pair of extension arm plates, and two cover plates, the positioning seat having a chamber to receive the extension seat, a bottom notch, a pair of channels, a plurality of positioning holes communicating with the channels, and a pair of inner threaded posts, the extension seat having two pairs of pivot apertures, and two lateral walls, each of the extension arm plates having a first hollow column inserted in the corresponding channel of the positioning seat and a second hollow column inserted in the extension seat, the first hollow column receiving a spring and two studs, the second hollow column receiving a spring and two pivot shafts, each said pivot shaft having an arbor, each said cover plate disposed on the corresponding first hollow column, each said cover plate having two blind holes and two hollow lugs, the hollow lugs matching the inner threaded posts, each said arbor inserted in the corresponding pivot aperture of the extension seat, one stud inserted in one of the positioning holes of the positioning seat, and the other stud inserted in one of the blind holes of the cover plate, and a screw fastening the corresponding hollow lug and the corresponding inner threaded post together.

2. The suitcase carrier as claimed in claim 1, wherein the extension seat has two confining rods disposed on the lateral walls.

* * * * *